US011366429B2

(12) United States Patent
Monferrer

(10) Patent No.: US 11,366,429 B2
(45) Date of Patent: Jun. 21, 2022

(54) MECHANICAL DIGITAL DISPLAY FOR TIMEPIECES

(71) Applicant: Blancpain SA, Le Brassus (CH)

(72) Inventor: Bernat Monferrer, St-Prex (CH)

(73) Assignee: Blancpain SA, Le Brassus (CH)

( * ) Notice: Subject to any disclaimer, the term of this patent is extended or adjusted under 35 U.S.C. 154(b) by 352 days.

(21) Appl. No.: 16/589,304

(22) Filed: Oct. 1, 2019

(65) Prior Publication Data

US 2020/0117145 A1 Apr. 16, 2020

(30) Foreign Application Priority Data

Oct. 10, 2018 (EP) ..... 18199518

(51) Int. Cl.
*G04C 17/00* (2006.01)
*G04C 3/00* (2006.01)
(Continued)

(52) U.S. Cl.
CPC ..... *G04C 17/0091* (2013.01); *G04C 3/008* (2013.01); *G04G 9/0082* (2013.01); *G04G 9/087* (2013.01)

(58) Field of Classification Search
CPC .. G04C 17/0091; G04C 3/008; G04G 9/0082; G04G 9/087; G04B 19/207; G04B 19/20
(Continued)

(56) References Cited

U.S. PATENT DOCUMENTS 3,024,590 A * 3/1962 Wynne ..... G04B 19/207 368/191
3,597,918 A * 8/1971 Robinson ..... G06M 1/163 368/222
(Continued)

FOREIGN PATENT DOCUMENTS

CH 107 098 B1 11/2010
CN 103748521 A 4/2014
(Continued)

OTHER PUBLICATIONS

Office Action dated Sep. 15, 2020 in corresponding Japanese Patent Application No. 2019-181127 (with English Translation), 6 pages.
(Continued)

*Primary Examiner* — Edwin A. Leon
(74) *Attorney, Agent, or Firm* — Oblon, McClelland, Maier & Neustadt, L.L.P.

(57) ABSTRACT

A digital display mechanism for the alphanumeric segment display of an integer magnitude whose instantaneous value is defined by an output of a timepiece movement, including a continuous display support guided along a particular trajectory by a guide device and driven in at least one direction of travel by a drive device, including at least a first display surface and a second display surface which are different from each other, each first surface or second surface forming only one part of an alphanumeric symbol, numeral or letter, and arranged to be visible to a user of the timepiece, each continuous display support being either a serrated belt driven by a serrated pinion complementary to the serration of the belt, or a chain driven by a pinion complementary to the articulation of the links of this chain.

30 Claims, 4 Drawing Sheets

(51) Int. Cl.
*G04G 9/00* (2006.01)
*G04G 9/08* (2006.01)

(58) Field of Classification Search
USPC ..... 368/223
See application file for complete search history.

(56) References Cited

U.S. PATENT DOCUMENTS

| | | | | |
|---|---|---|---|---|
| 3,645,087 | A * | 2/1972 | Rams | G04B 19/20 368/40 |
| 5,299,178 | A | 3/1994 | Belik | |
| 8,355,297 | B2 * | 1/2013 | Wilbur | G04B 19/207 368/78 |

FOREIGN PATENT DOCUMENTS

| | | | |
|---|---|---|---|
| CN | 104049520 | A | 9/2014 |
| CN | 105573097 | A | 5/2016 |
| CN | 105573098 | A | 5/2016 |
| FR | 2.043.537 | | 2/1971 |

OTHER PUBLICATIONS

European Search Report dated Apr. 4, 2019 in European Application 18199518.4, filed on Oct. 10, 2018 (with English Translation of Categories of Cited Documents).
Combined Chinese Office Action and Search Report dated Feb. 7, 2021 in corresponding Chinese Patent Application No. 201910954085.X (with English Translation and English Translation of Category of Cited Documents) citing documents AO-AQ therein, 10 pages.

* cited by examiner

MECHANICAL DIGITAL DISPLAY FOR TIMEPIECES

CROSS-REFERENCE TO RELATED APPLICATION

This application claims priority to European Patent Application No. 18199518.4 filed on Oct. 10, 2018, the entire disclosure of which is hereby incorporated herein by reference.

FIELD OF THE INVENTION

The invention concerns a digital display mechanism for timepieces, for the alphanumeric segment display of at least one integer magnitude whose instantaneous value is defined by an output of a timepiece movement, said digital display mechanism comprising at least one continuous display support guided along a particular trajectory by guide means, and comprising, for each said continuous display support, drive means arranged to drive it in at least one direction of travel, each said continuous display support comprising at least a first surface and at least a second surface which are arranged to be visible to a user of said timepiece and different from one another and which are display surfaces.

The invention also concerns a timepiece movement including at least one display mechanism of this type.

The invention also concerns a timepiece, especially a watch, including at least one such timepiece movement, and/or at least one such display mechanism.

The invention concerns the field of timepiece display mechanisms.

BACKGROUND OF THE INVENTION

The display of the time, or of other information accessible in a timepiece, has long been performed by rotating display members such as hands, or discs or the like. Discs have numbers that are immediately readable but are bulky and consequently difficult to use in a watch to display both the hour and the minutes.

Early embodiments of such a digital display, which was easier to read, exist in clocks, such as the Semperoper clock in Dresden, made by Gutkaes in 1842.

Pallweber separated the tens and units discs in 1883, which made it possible to display large readable numbers. However, the problem of bulkiness remains.

This problem was solved with the arrival of digital electronic LED watches, such as the Hamilton Pulsar watch in 1970.

Purely mechanical solutions were then reserved for complicated watches, for which size and cost were almost secondary, and few alternatives to the traditional discs have been proposed.

EP Patent No. 1906266B1 in the name of DE GRISOGONO thus discloses a mechanical digital display, with a digit formed by at least seven segments in the form of rods pivoting about parallel axes at the bottom of the watch, and each having two areas of different appearance, and whose rotation is controlled by a cam and pinion gear. However, this spectacular display requires significant depth inside the watch case.

US Patent Application No. 5299178A in the name of BELIK discloses a clock in which a motor drives a chain, some links of which carry indices, each bearing a numeral and which move in front of a complementary scale, in particular, the indices indicate the hour values and the complementary scale is a sector graduated in minutes.

FR Patent No. 2043537 in the name of BRAUN discloses a clock with a display via moving tablets, and which also includes at least one endless belt, of the serrated belt type or suchlike, carrying a complementary display, for example the date, the day of the week or the current month.

CN Patent Application No. 104049520A in the name of TIANJIN SEA GULL discloses a chain wherein one of the links bears a display index.

CH Patent No. 701098B1 in the name of HAUTLENCE discloses an articulated chain or belt type puller, wherein each link bears a complete indication that can immediately be read by the user.

SUMMARY OF THE INVENTION

The invention proposes to make a mechanical digital display, compatible with the conventional size of a watch case, particularly with respect to its thickness, and which is able to perform various displays.

To this end, the invention concerns a timepiece digital display mechanism according to claim 1.

The invention also concerns a timepiece movement including at least one display mechanism of this type.

The invention also concerns a timepiece, especially a watch, including at least one such timepiece movement, and/or at least one such display mechanism.

BRIEF DESCRIPTION OF THE DRAWINGS

Other features and advantages of the invention will appear upon reading the following detailed description, with reference to the annexed drawings, in which:

FIGS. 12 and 13, and 14 and 15 respectively, represent two assembly variants of different decorative elements.

Likewise.

FIG. 23 and FIG. 24 illustrate the path of an endless chain on each of these groups of segments.

FIGS. 25 to 27 illustrate the encoding of the numbers from zero to two, through a combination of light and dark sections of each of the two upper and lower chains; the encoding of all the numbers can be obtained in at most eight basic steps of the upper chain, as seen in FIG. 26, and in at most five basic steps of the lower chain, as seen in FIG. 27.

FIG. 30 is a block diagram representing a watch including a movement having control means, moved into a display mechanism in order to control its drive means which cause the movement of chains or the like.

DETAILED DESCRIPTION OF PREFERRED EMBODIMENTS

Figure 1:
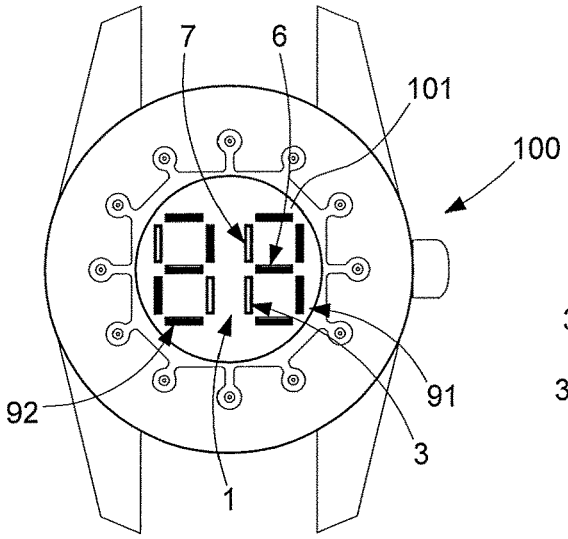
FIG. 1 represents a schematic front view of a watch comprising a mechanism for the digital display of the hours according to the invention, by the links of chains arranged behind a dial, in a twenty-four hour display variant.

The invention concerns a timepiece digital display mechanism 1, for the alphanumeric segment display of at least one integer magnitude whose instantaneous value is defined by an output 52 of a timepiece movement 50, incorporated in a timepiece 100.

This magnitude may be a temporal magnitude such as a display of the hour, day, month, year, morning/evening, day/night, moon phase, tide, moon age or similar, it may also be a state magnitude, such as the display of an activated/non-activated function, the coding of time zones, or otherwise.

This digital display mechanism 1 includes at least one continuous display support 3, which is guided along a particular trajectory 4 by guide means 5.

Digital display mechanism 1 includes, for each continuous display support 3, drive means 2, which are arranged to drive it in at least one direction of travel. In a variant, these drive means 2 are arranged to drive at least one continuous display support 3 in the two opposite directions of travel.

Each continuous display support 3 comprises at least a first surface 6 and at least a second surface 7, which are arranged to be visible to a user of timepiece 100 and which are different from one another and which are display surfaces.

According to the invention, each first surface 6 or second surface 7 forms only one part of an alphanumeric symbol, numeral or letter.

And, according to the invention, at least one such continuous display support 3 is either a serrated belt 39, whose drive means 2 include at least one serrated pinion 390 complementary to its serration, or a chain 30 whose drive means 2 include at least one pinion 28 complementary to the articulation of links 38 comprised in chain 30.

And this digital display mechanism 1 includes at least one display member 91, 92, 93, for the segment display of a numeral, in particular an Arabic numeral from zero to nine, or a Roman numeral, or another type of numeral, or a letter, in particular a Latin letter, or more particularly still a Latin letter from A to F.

And this digital display mechanism 1 includes a first continuous display support 31, which is arranged for display on first segments 310, and a second continuous display support 32 for display on second segments 320.

In particular, first surface 6 or second surface 7 has an identical or similar appearance to that of a dial, comprised in a timepiece 100 incorporating the display mechanism according to the invention, and underneath which dial is arranged the chain or serrated belt mechanism, depending on the case. Thus, the appearance of the other surface contrasts sharply with the rest of the display environment.

More particularly, first surfaces 6 and second surfaces 7 of continuous display support 3 are substantially planar and are perpendicular to the direction of an axis of rotation about which drive means 2 are rotatable. In particular, they are parallel to a plate of the movement, or to a watch dial, or to the back cover of a watch case, or to a watch crystal.

In an advantageous variant, at least one continuous display support 3 forms a closed loop. More particularly, each continuous display support 3 forms a closed loop.

Figure 31:
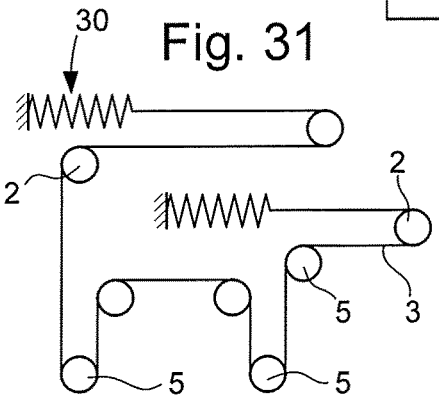
FIG. 31 illustrates a variant in which a display chain is not closed, but open and returned at both ends thereof by springs attached to a fixed structure.
Figure 32:
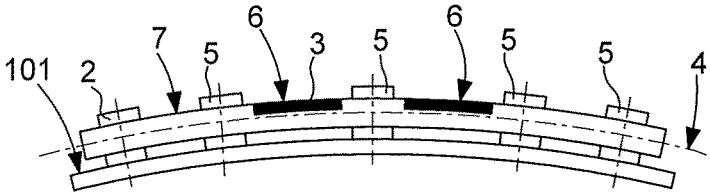
FIG. 32 illustrates a variant in which the display mechanism is no longer planar as in all the preceding Figures but follows a slight bulge of a plate or of the back cover of the watch case.
Figure 33:
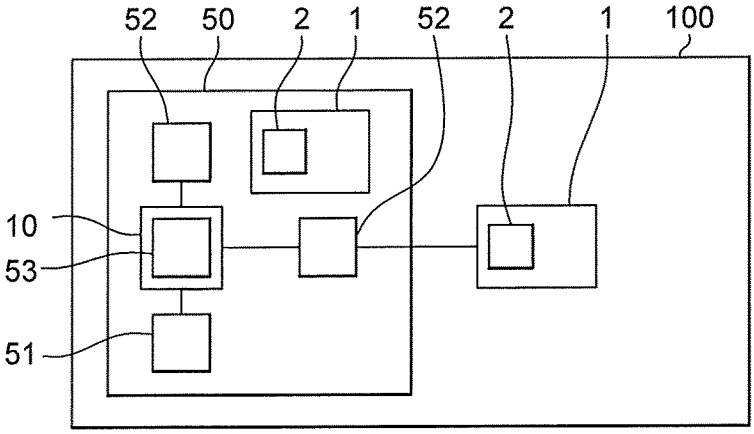
FIG. 33 is a similar block diagram to FIG. 30, in which the movement includes a drive means driving outputs for the display of a magnitude, and in which the control means include encoding means to define for each output the direction of its movement and the amplitude of its travel according to the instantaneous value of the magnitude to be displayed.

In another variant, as seen in FIG. 31, at least one continuous display support 3 forms an open loop.

More particularly, digital display mechanism 1 includes means 30 for tensioning at least one continuous display support 3, for example in the form of a tensioner pulley, a spring, or otherwise.

In a particular variant, at least one trajectory 4 of a continuous display support 3 is substantially planar. More particularly, each trajectory 4 of each continuous display support 3 is substantially planar. More particularly still, all of trajectories 4 are coplanar.

Figure 16:
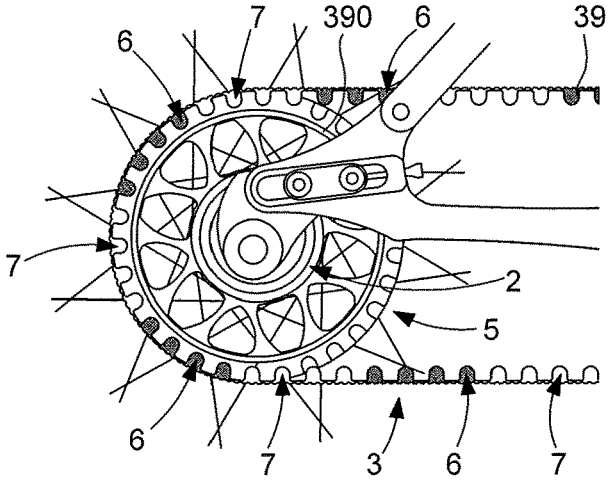
FIG. 16 represents a schematic, front view of a variant of the display mechanism including a serrated belt, in which the edges of the notches have visible surfaces of a different nature depending on the notches.

According to the variant of FIG. 16, at least one continuous display support 3 is a serrated belt 39, and its drive means 2 include at least one serrated pinion 390 complementary to its serration. The first surfaces 6 and second surfaces 7 are then on the edge of serrated belt 39, and several successive notches define a curvilinear segment having a certain appearance.

Figure 10:
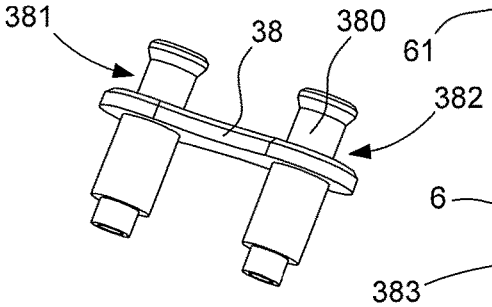
FIG. 10 shows a schematic, perspective view of a link of the section of FIG. 8.
Figure 12:
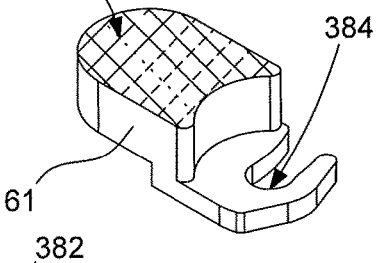
FIGS. 12 to 15 represent schematic, perspective views at different angles of such an added element, with its elements for connection and attachment to articulation pins of the chain.
Figure 14:
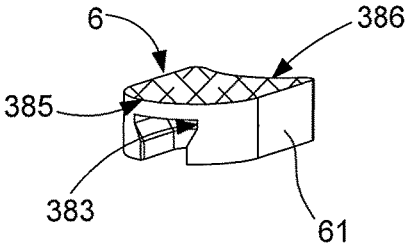
Figure 13:
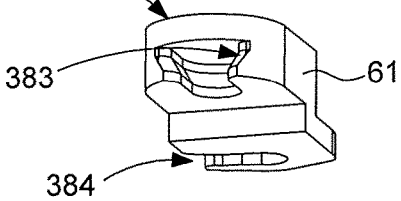
Figure 15:
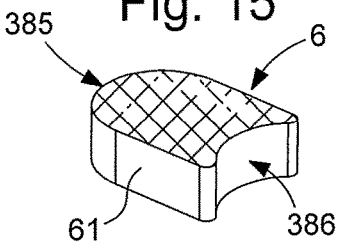

According to the particular variant of FIGS. 8 to 15, at least one continuous display support 3 is a chain 30, and its drive means 2 include at least one star 28 arranged to form a pinion complementary to the articulation of links 38 comprised in chain 30. Other stars 28, which are freely mounted or braked, advantageously form guide means. Naturally, the drive means and the guide means may take other forms, provided that the space reserved for insertion of the display mechanism is respected. In the particular embodiment illustrated by FIGS. 8 to 15, each link 38 includes, in a conventional manner, two plates—upper and lower—articulated at each end to two plates of an adjacent link about an articulation pin 380, the various plates being held apart by at least one spacer. More particularly, each articulation pin 380 has a shoulder 382, limited by an axial stop 381. Advantageously, this chain 30 is a timepiece chain, particularly of the type used on a barrel fusee or similar, whose dimensions are well suited to the present Application. The mounting of each link 38 of the chain, similar to that of a bicycle chain, is easy because of pins 380, which each traverse the two upper and lower plates seen in FIGS. 8 and 11, of which only the upper plate is represented in FIG. 10.

In a simple variant, links 38 of a chain 30, or the notches of a serrated belt 390, directly carry first surfaces 6 and second surfaces 7.

In a particular embodiment, at least one continuous display support 3 includes at least a first added element 61 visible to the user and bearing a first surface 6 and/or a least a second added element 62 visible to the user and bearing a second surface 7.

In the variant illustrated by FIGS. 11 to 15, each chain link 38 carries one such first added element 61 visible to the user and bearing a first surface 6, or one such second added element 62 visible to the user and bearing a second surface 7. Here, each of these added elements 61 or 62 includes on the lower level, for retention thereof on chain 30, at a first end a hook 384 arranged to cooperate in a complementary manner with shoulder 382 of a pin 380, and at a second end a recess 383 arranged to cooperate in a complementary manner with mushroom-shaped axial stop 381 in the upper part of a pin 380; on the visible upper level, at one end an edge with a male cylindrical profile 385, and at the other end an edge with a female cylindrical profile 386, and the assembly of added elements 61 and 62 forms a substantially continuous visible surface.

Naturally, the variant with a serrated belt 39 can also include such an arrangement with added elements.

In a variant, the drive means 2 of at least one continuous display support 3 are arranged to continuously drive said support.

In another variant, the drive means 2 of at least one continuous display support 3 are arranged to drive said support in steps. FIGS. 20 to 22 and 25 to 27 illustrate, in matrix form, display change sequences by the process of a certain number of steps, on each continuous display support 3. This number of steps is limited to around ten, the display change is then quite quick, and this display change provides a visual animation of the timepiece which offers a novel attraction for the user.

More particularly, each first surface 6 and/or each second surface 7 of continuous display support 3 covers an integer number of steps.

More particularly, the drive means 2 of at least one continuous display support 3 are arranged to drive said support, during a display change, through a number of steps determined by the output 52 of movement 50.

More particularly, the drive means 2 of at least one continuous display support 3 are arranged to drive said support, during a display change, in a direction determined by output 52 of movement 50.

In a variant, at least one continuous display support 3 is partially hidden from the user by a cover 11 having at least one aperture 12, or a translucent or transparent zone, leaving at least part of continuous display support 3 visible to the user. This cover 11 can be formed by a dial or the like.

More particularly, this aperture 12, or this translucent or transparent zone, includes at least one open segment whose length is equal to one step or to an integer number of steps.

Figure 17:
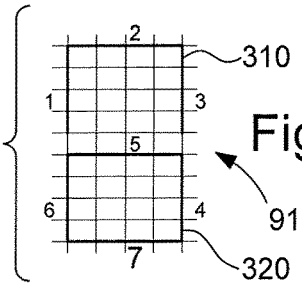
FIG. 17 illustrates the digital display of the units, from zero to nine, on the basis of segments arranged in an upper group of three segments and a lower group of four segments.
Figure 18:
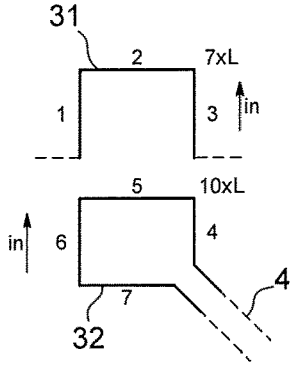
FIG. 18 and FIG. 19 illustrate the path of an endless chain on each of these groups of segments.
Figure 19:
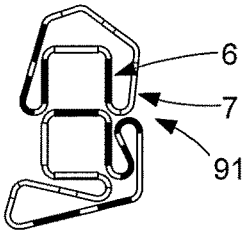
Figure 20:
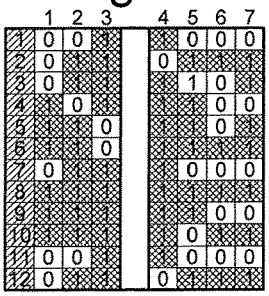
FIGS. 20 to 22 illustrate the encoding of the numbers from zero to nine, through a combination of light and dark sections of each of the two upper and lower chains; the encoding of all the numbers can be obtained in at most seven basic steps of the upper chain, as seen in FIG. 21, and in at most ten basic steps of the lower chain, as seen in FIG. 22.
Figure 21:
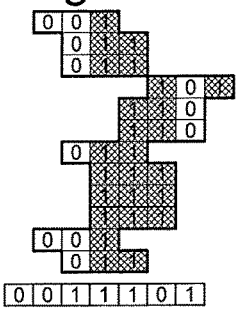
Figure 22:
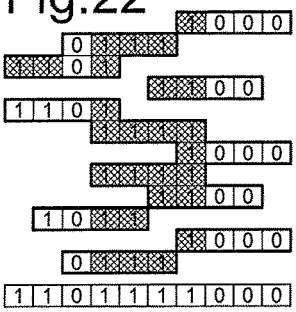

In a variant, as seen in particular in FIGS. 17 to 19, digital display mechanism 1 includes at least a first display member 91 for the seven-segment display of a numeral from zero to nine, or of a Latin letter, for example from A to F, or otherwise, and digital display mechanism 1 includes a first continuous display support 31, which is arranged for display on three or four first segments 310, and a second continuous display support 32 for display over respectively four or three second segments 320.

Figure 23:
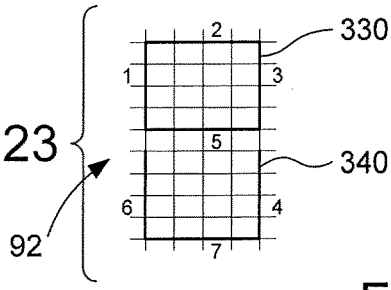
FIGS. 23 to 27 illustrate the digital display of the tens, on a twenty-four hour display, from zero to two, on the basis of segments arranged in an upper group of four segments and a lower group of three segments.
Figure 24:
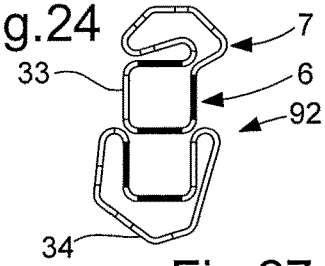
Figure 25:
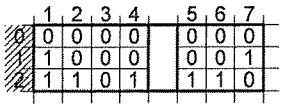
Figure 26:
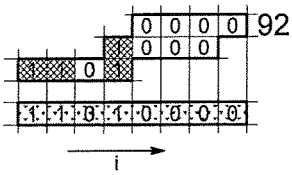
Figure 27:
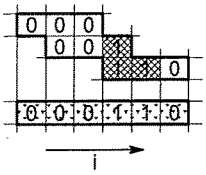
Figure 28:
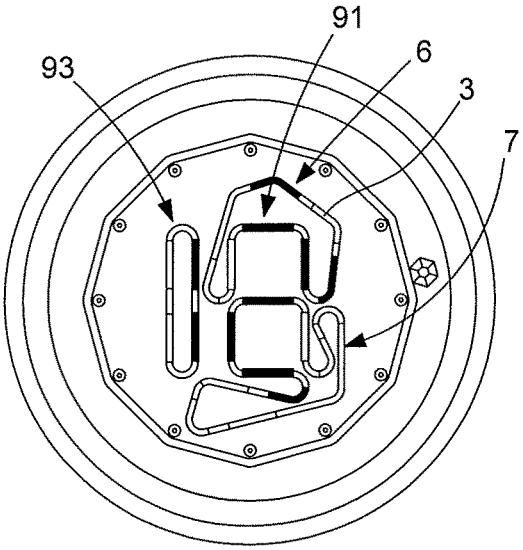
FIG. 28 represents in a similar manner to FIG. 7, with the dial removed, a variant comprising three chains, for a twelve-hour display.
Figure 29:
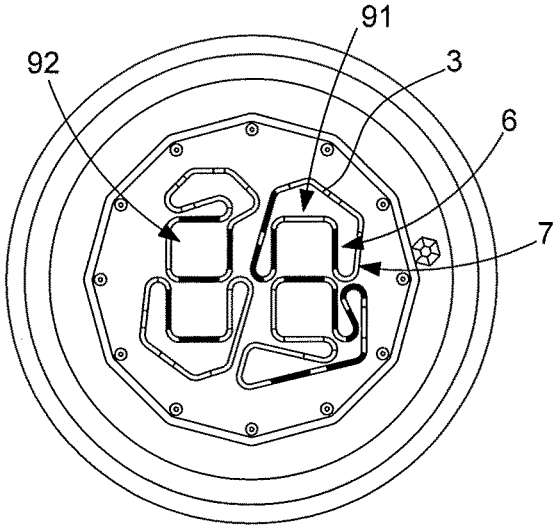
FIG. 29 represents, in a similar manner to FIG. 7, with the dial removed, another variant including four chains, for a twenty-four hour display.
Figure 30:
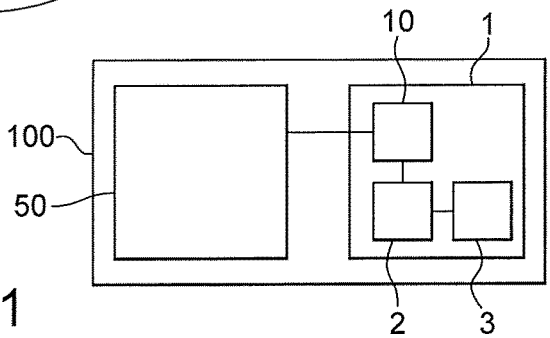

In another variant, as seen in particular in FIGS. 23 and 24, digital display mechanism 1 includes at least a second display member 92 for the seven-segment display of a tens numeral, or a dozens numeral, or a numeral from zero to two, and digital display mechanism 1 includes a third continuous display support 33, which is arranged for display on four or three third segments 330, and a fourth continuous display support 34 for display respectively on three or four fourth segments 340.

Figure 2:
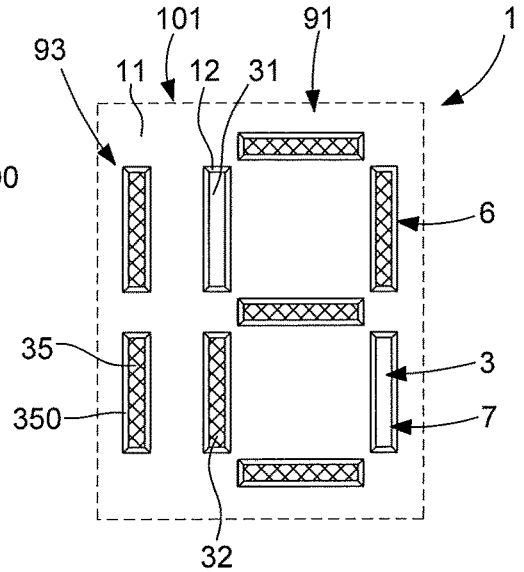
FIG. 2 represents, in a similar manner, a detail of the central part of a watch with a twelve-hour display, with a different display value.
Figure 3:
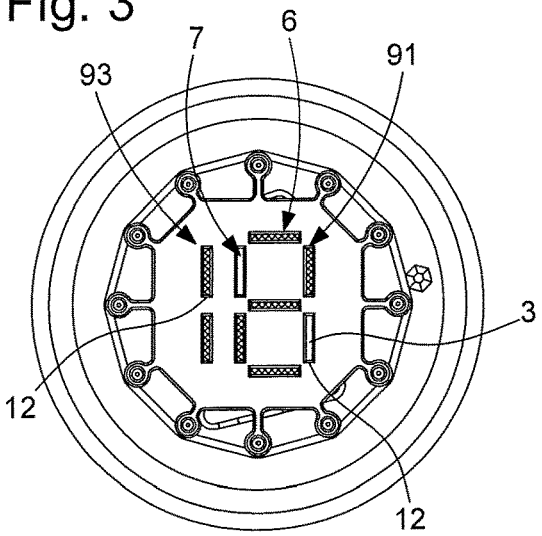
FIG. 3 is another view of the watch of FIG. 2; this watch includes yet another display by a minute chain, which surrounds the decimal displays, and which is guided or driven at the level of twelve elements, which are arranged in a regular and equidistant manner with an angular pitch of 30°, and which drives a tangential movable element, formed here by a cut stone visible around the three o'clock position.
Figure 4:
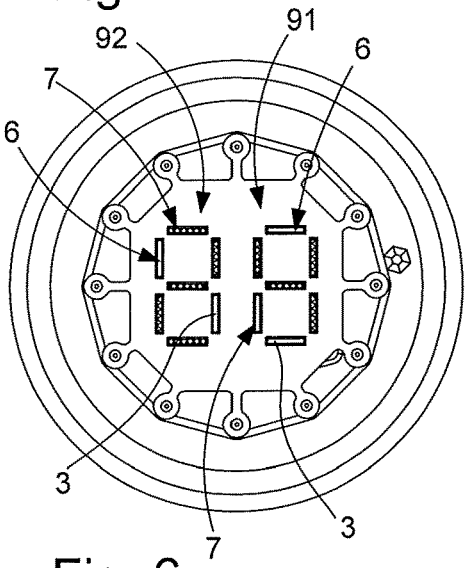
FIG. 4 is another view of the watch of FIG. 3, in another display position.
Figure 5:
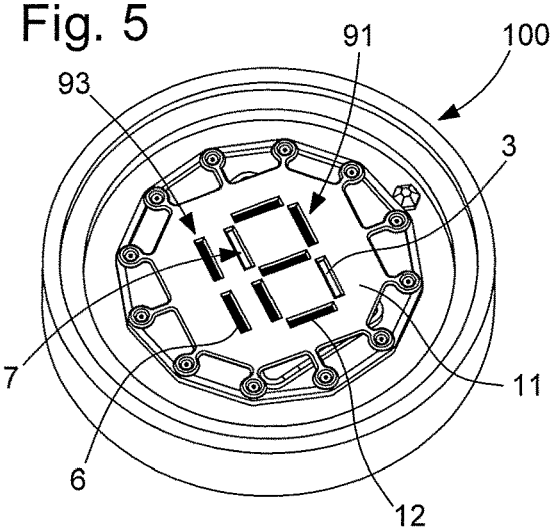
FIG. 5 is a perspective view of the watch of FIG. 3.
Figure 6:
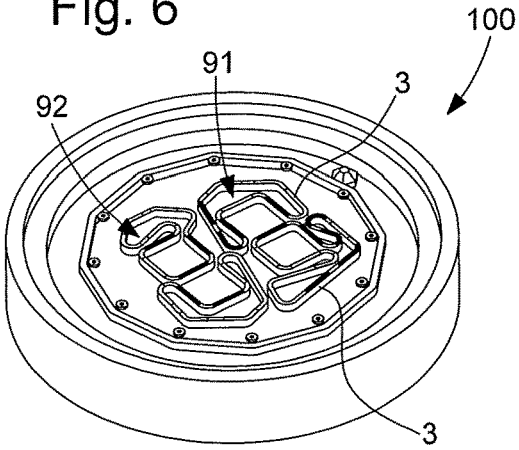
FIG. 6 is a perspective view of the watch of FIG. 4, from which the dial has been removed, and where four chains can be seen in a simplified diagram, in which each decimal of the display is formed by two continuous chains including visible surfaces of a different nature depending on the links.
Figure 7:
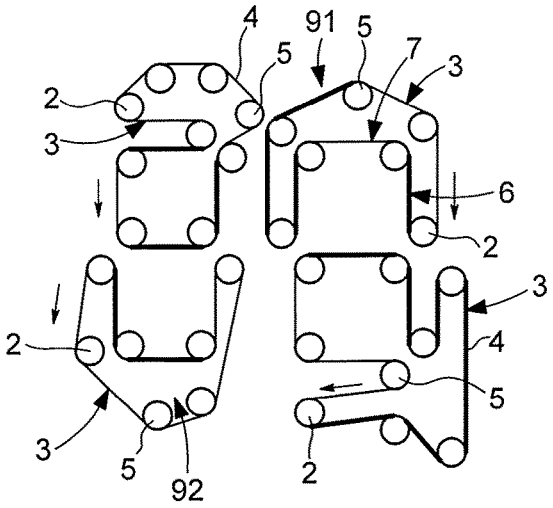
FIG. 7 represents a schematic front view, with the dial removed, of a digital display mechanism including four chains, in a twenty-four hour display variant.
Figure 8:
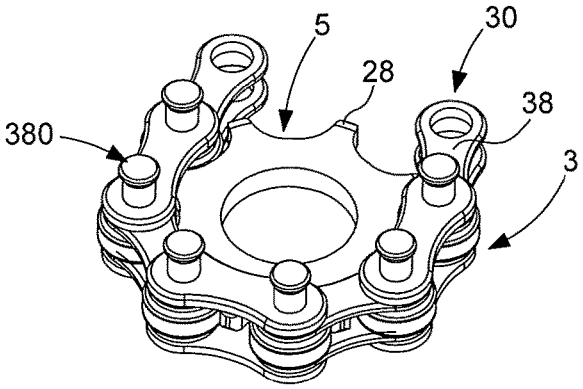
FIG. 8 represents a schematic, perspective view of a section of such an articulated chain, cooperating with a star which can form a guide means or a drive pinion.
Figure 9:
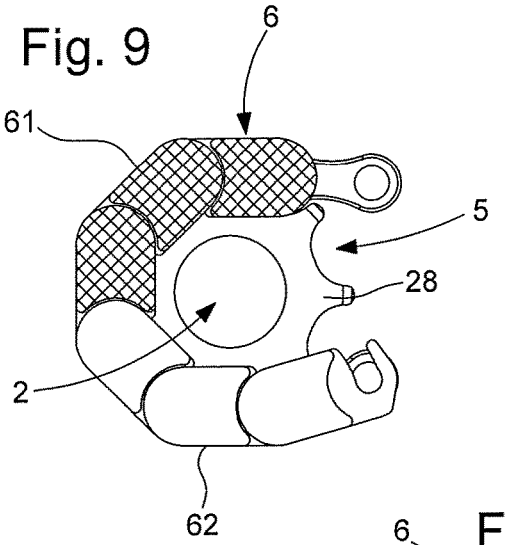
FIG. 9 is a plan view of the section of FIG. 8, with representation of decorative elements of different natures.
Figure 11:
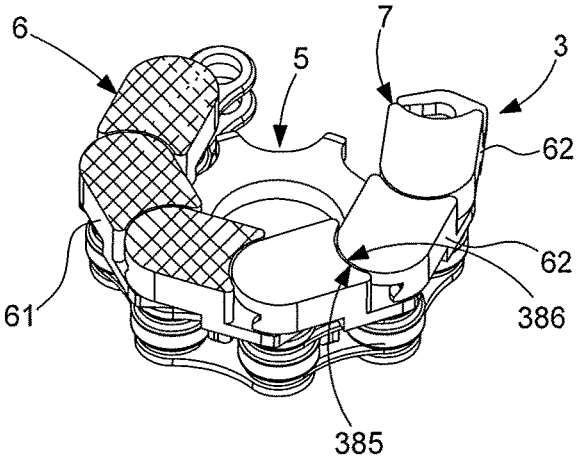
FIG. 11 represents a schematic, perspective view of the section of FIG. 8, in which each link is covered with a first added element having a first appearance, or with a second added element having a second appearance.

In another variant, as seen in particular in FIG. 2, digital display mechanism 1 includes at least a third, one or two segment display member 93 for the display of a numeral one or for an empty display, and digital display mechanism 1 includes a fifth continuous display support 35 for display on an alignment of rectilinear segments 350 or on a single rectilinear segment 350.

The coding matrices seen in the Figures optimise the length of the chains and limit the number of steps to be taken to change from one display position to another.

In a particular application, digital display mechanism 1 is arranged for a display of the hours, or of the minutes, or of the hours and minutes.

In another application, digital display mechanism 1 is arranged for an AM/PM display and/or for a day/night display.

In yet another application, digital display mechanism 1 is arranged for a display of the decimal code of the current month.

Digital display mechanism 1 can also concern many other alphanumeric displays, such as the coding of time zones, of the day of the week, of the moon phase, of the leap year, of the power reserve, or otherwise.

In a particular and very spectacular variant, digital display mechanism 1 according to the invention is an on-demand mechanism: as in a minute repeater, the user starts a time position search or similar, and his mechanical action on an actuator supplies energy to the chain drivers or similar to perform the display under the eyes of the user. The user can then choose to keep the last displayed position visible, or to return to zero in a neutral display position, or to return the timepiece to the real time display.

More particularly, digital display mechanism 1 is arranged to be mounted parallel to a dial and/or to a crystal and/or to a plate and/or to a case back, comprised in a movement 50 or a watch 100, and each serrated belt 39 or each chain 30 comprised in digital display mechanism 1 extends in a plane parallel to each first surface 6 and to each second surface 7, this plane being arranged to be parallel to a dial and/or to a crystal and/or to a plate and/or to a case back.

The same chain 30 or serrated belt 390 can also be used for driving other display wheel sets, for example rotating pinions or other elements.

FIGS. 1, 3 to 6, 28 and 29 illustrate another display with a minute chain, which could also be a belt, and which here surrounds the decimal displays. This chain, which is a minute chain here, is guided or driven at the level of twelve elements, which are arranged, in the non-limiting variant of the Figures, in a regular and equidistant manner with an angular pitch of 30° corresponding to the classic five-minute display; this chain can drive a tangential wheel set, seen here around the three o'clock position, or be driven by such a wheel set, which can be outside or within the perimeter of the chain. Naturally, the chain itself can directly provide the display by positioning a contrasting area in front of a fixed marking, and/or driving an additional display member, such as a disc or a hand or a display element. such as a gem or a cut stone as seen in FIGS. 3 to 6, or suchlike, or driving another chain via an intermediate wheel.

It is clear that the possibilities of application are very extensive, to very different types of display, such as day/night, AM/PM, moon phase, tide, moon age, time zone, power reserve, or otherwise.

The invention also concerns a movement 50 for a timepiece 100, including at least one mechanical and/or electrical drive means 51 arranged for driving at least one output 52 for the display of a magnitude.

More particularly, this movement 50 includes control means 10, which are arranged to process information relating to the instantaneous value of each magnitude to be displayed, and/or information relating to the change of integer value of the magnitude, and, with reference to coding means 52 comprised in control means 10, to define for output 52 the direction of its movement and the amplitude of its travel according to the instantaneous value of the magnitude to be displayed.

And this movement 50 includes at least one digital display mechanism 1 or is arranged to drive at least one such digital display mechanism 1.

More particularly, for each continuous display support 3, the drive means 2 are arranged to be driven by an output 52, and control means 10 are arranged, during each change of integer value of a magnitude, to drive output 52 corresponding to the magnitude, to drive drive means 2 to provide the digital display of the new instantaneous value of the magnitude.

The invention also concerns a timepiece 100 including at least one such movement 50.

More particularly, the timepiece includes at least one dial 101 in front of or behind which at least one continuous display support 3 is arranged to move. More particularly, at least one continuous display support 3 includes each first surface 6 or each second surface 7 of similar appearance to that of dial 101 in front of which the continuous display support 3 is arranged to move, with the other surface then contrasting with the decoration of dial 101.

More particularly, at least one dial 101 includes at least one cover 11 including at least one aperture 12, or a translucent or transparent zone, leaving at least one part of continuous display support 3 visible to the user, and arranged to conceal from the user the rest of continuous display support 3.

More particularly, this timepiece 100 is a watch.

In short, the invention proposes an innovative display principle, and a novel manner of displaying the time, or of displaying any other information that can be coded in digital or alphanumeric form, relating to the state of the timepiece.

The invention uses a chain transmission with watch-sized gears and makes it possible to produce a large digital display, which is always advantageous since it is very easy for the user to read.

This display can be central or be arranged in any suitable place in the timepiece.

The invention enhances the display change, by unprecedented animation in the timepiece, with a chain or belt movement that is clearly visible to the user, yet fast enough to quickly restore a stable display.

The use of chains or serrated belts is uncommon for display mechanisms, the chain can, moreover, remain at least partially visible, because of its very particular appearance.

The mechanism is very thin, can easily be integrated in an existing watch case, and it is no longer necessary to reserve height for the hands.

The external parts of a watch require few or no modifications to integrate a display mechanism according to the invention.

The principle of the invention is flexible enough to adapt to any numeral or letter writing style which can be symbolised by a juxtaposition of segments.

The invention claimed is:

1. A digital display mechanism for a timepiece, for alphanumeric segment display of at least one integer magnitude whose instantaneous value is defined by an output of a timepiece movement, said digital display mechanism comprising:

a plurality of continuous display supports guided along a particular trajectory by guide means; and drive means for each of the plurality of continuous display supports, each of the drive means is arranged to drive a respective continuous display support in at least one direction of travel, wherein each said continuous display support includes at least a first surface and at least a second surface arranged to be visible to a user of said timepiece and different from each other, and which are display surfaces, wherein each said first surface or second surface forms only one part of an alphanumeric symbol, numeral or letter, wherein at least one said continuous display support is either a serrated belt whose said drive means include at least one serrated pinion complementary to the serration thereof, or a chain whose said drive means include at least one pinion complementary to the articulation of links comprised in said chain, wherein said digital display mechanism includes at least one display member for the segment display of a numeral, or of a letter, and wherein the plurality of continuous display supports includes a first continuous display support arranged for display on first segments, and a second continuous display support for display on second segments.

2. The digital display mechanism according to claim 1, wherein said digital display mechanism includes at least a first display member for a seven-segment display of a numeral, or of an Arabic numeral from zero to nine, or of a letter, or of a Latin letter, and wherein said digital display mechanism includes a first continuous display support arranged for display on three or four first segments, and a second continuous display support for display respectively on four or three second segments.

3. The digital display mechanism according to claim 1, wherein said digital display mechanism includes at least a second display member for a seven-segment display of a tens numeral, or a dozens numeral, or a numeral from zero to two, and wherein said digital display mechanism includes a third continuous display support for display on four or three third segments, and a fourth continuous display support for display respectively on three or four fourth segments.

4. The digital display mechanism according to claim 1, wherein said digital display mechanism includes at least a third, one or two segment display member for the display of a numeral one or for an empty display, and wherein said digital display mechanism includes a fifth continuous display support for display on an alignment of rectilinear segments or on a single rectilinear segment.

5. The digital display mechanism according to claim 1, wherein said first surfaces and second surfaces of said continuous display support are substantially planar and perpendicular to the direction of an axis of rotation about which said drive means are rotatable.

6. The digital display mechanism according to claim 1, wherein at least one said continuous display support forms a closed loop.

7. The digital display mechanism according to claim 1, wherein at least one said continuous display support forms an open loop.

8. The digital display mechanism according to claim 1, wherein said digital display mechanism includes means for tensioning at least one said continuous display support.

9. The digital display mechanism according to claim 1, wherein at least one said trajectory of a said continuous display support is substantially planar.

10. The digital display mechanism according to claim 1, wherein at least one said continuous display support is a serrated belt, and wherein said drive means thereof include at least one serrated pinion complementary to the serration of said belt.

11. The digital display mechanism according to claim 1, wherein at least one said continuous display support is a chain, and wherein said drive means thereof include at least one pinion complementary to the articulation of the links of said chain.

12. The digital display mechanism according to claim 1, wherein said drive means of at least one said continuous display support are arranged to drive said support in two opposite directions of travel.

13. The digital display mechanism according to claim 1, wherein said drive means of at least one said continuous display support are arranged to continuously drive said support.

14. The digital display mechanism according to claim 1, wherein said drive means of at least one said continuous display support are arranged to drive said support in steps.

15. The digital display mechanism according to claim 14, wherein each said first surface and/or each said second surface of said continuous display support covers an integer number of said steps.

16. The digital display mechanism according to claim 14, wherein said drive means of at least one said continuous display support are arranged to drive said support, during a display change, through a number of steps determined by said output of said movement.

17. The digital display mechanism according to claim 12, wherein said drive means of at least one said continuous display support are arranged to drive said support, during a display change, through a number of steps determined by said output of said movement, and wherein said drive means of at least one said continuous display support are arranged to drive said support, during a display change, in a direction determined by said output of said movement.

18. The digital display mechanism according to claim 1, wherein at least one said continuous display support is partially hidden from the user by a cover having at least one aperture, or a translucent or transparent zone, leaving at least one part of said continuous display support visible to the user.

19. The digital display mechanism according to claim 16, wherein at least one said continuous display support is partially hidden from the user by a cover having at least one aperture, or a translucent or transparent zone, leaving at least one part of said continuous display support visible to the user, and wherein said aperture, or said translucent or transparent zone, includes at least one open segment whose length is equal to one said step or to an integer multiple of said step.

20. The digital display mechanism according to claim 1, wherein at least one said continuous display support includes at least a first added element visible to the user and bearing a said first surface and/or a least a second added element visible to the user and bearing a said second surface.

21. The digital display mechanism according to claim 1, wherein said digital display mechanism is arranged for a display of the hours, or of the minutes, or of the hours and minutes.

22. The digital display mechanism according to claim 1, wherein said digital display mechanism is arranged for an AM/PM display and/or for a day/night display.

23. The digital display mechanism according to claim 1, wherein said digital display mechanism is arranged for a decimal display of the current month.

24. The digital display mechanism according to claim 9, wherein said digital display mechanism is arranged to be mounted parallel to a dial and/or to a crystal and/or to a plate and/or to a case back, comprised in a movement or a watch, and wherein each said serrated belt or each said chain comprised in said digital display mechanism extends in a plane parallel to each said first surface and to each said second surface, said plane being arranged to be parallel to a said dial and/or to a said crystal and/or to a said plate and/or to a said case back.

25. A movement for a digital display mechanism, including at least one mechanical and/or electrical drive means arranged for driving at least one output for the display of a magnitude, said movement comprising:

control means, which are arranged to process information relating to the instantaneous value of each said magnitude to be displayed, and/or information relating the change of integer value of said magnitude, and/or information relating to a change of integer value of the magnitude, and, with reference to coding means comprised in control means, to define for output a direction of its movement and an amplitude of its travel according to the instantaneous value of the magnitude to be displayed, wherein said movement includes or is arranged to drive at least one digital display mechanism of the timepiece according to claim 1, wherein, for each said continuous display support, said drive means are arranged to be driven by said output, and wherein said control means are arranged, during each change of integer value of a said magnitude, to drive said output corresponding to said magnitude, in order to drive said drive means to provide the digital display of the new instantaneous value of said magnitude.

26. A timepiece comprising:

at least one movement according to claim 25.

27. The timepiece according to claim 26, wherein said timepiece includes at least one dial in front of or behind which at least one continuous display support is arranged to move.

28. The timepiece according to claim 27, wherein at least one said continuous display support includes each said first surface or each said second surface of similar appearance to that of said dial in front of which said continuous display support is arranged to move.

29. The timepiece according to claim 27, including at least one digital display mechanism according to claim 18, wherein at least one said dial includes at least one said cover including at least one aperture, or one said translucent or transparent zone, leaving at least one part of said continuous display support visible to the user, and arranged to conceal from the user the rest of said continuous display support.

30. The timepiece according to claim 26, wherein said timepiece is a watch.

* * * * *